United States Patent [19]

Noe et al.

[11] Patent Number: 4,702,308

[45] Date of Patent: Oct. 27, 1987

[54] MANIFOLD

[75] Inventors: Renato R. Noe, Union City, N.J.; Abraham L. Yarden, Los Angeles, Calif.

[73] Assignee: Southwestern Engineering Company, Los Angeles, Calif.

[21] Appl. No.: 649,472

[22] Filed: Sep. 11, 1984

Related U.S. Application Data

[60] Division of Ser. No. 527,371, Aug. 26, 1983, Pat. No. 4,473,112, which is a continuation of Ser. No. 236,646, Feb. 23, 1981, abandoned.

[51] Int. Cl.[4] ..... F28F 9/06

[52] U.S. Cl. ..... 165/76; 165/158; 165/113; 122/483

[58] Field of Search ..... 122/32, 483; 165/110–114, 158, 163, 174, 176, 76

[56] References Cited

U.S. PATENT DOCUMENTS

| | | | |
|---|---|---|---|
| 1,808,619 | 6/1931 | Uhde . | |
| 1,990,251 | 2/1935 | Potter . | |
| 2,154,177 | 4/1939 | Moray | 122/32 |
| 3,734,176 | 5/1973 | Hagnauer | 165/158 |
| 3,759,319 | 9/1973 | Ritland et al. | 165/176 X |
| 3,996,897 | 12/1976 | Herzog | 122/32 |
| 4,016,835 | 4/1977 | Yarden et al. | 122/483 |
| 4,106,559 | 8/1978 | Ritland et al. | 165/176 X |
| 4,166,497 | 9/1979 | Coit | 165/158 X |
| 4,325,428 | 4/1982 | Schuurman | 165/72 |

FOREIGN PATENT DOCUMENTS

| | | | |
|---|---|---|---|
| 2247691 | 5/1975 | France | 122/483 |
| 307068 | 2/1930 | United Kingdom . | |

OTHER PUBLICATIONS

Brochure entitled "How to Select Tubing for . . . Modern Feedwater Heaters" from Huntingdon Alloy Products Div. of International Nickel Co., Inc., 1/61.

*Primary Examiner*—Albert W. Davis, Jr.
*Attorney, Agent, or Firm*—Lyon & Lyon

[57] ABSTRACT

A header for a large heat transfer tube bundle having verticle U-bends. The header provides a four pass system employing the upper ends of the tubes for the first and third passes and the lower ends for the second and fourth passes. The header is arranged with a central divider and two boxes, one on either side of the divider. The boxes separate portions of the tubes from the main header cavities for the third and fourth passes. Condensate is removed after both the second and fourth passes. The first pass includes an inverted U-shaped configuration of tubes to increase available tube side heat to the outer sides of the tube bundle. The boxes include a gasket arrangement for separating portions of the tube bundle into various passes. A diffuser is also employed to better distribute incoming flow to the inverted U-shaped configuration of the first pass tubes.

5 Claims, 9 Drawing Figures

MANIFOLD

This is a division of application Ser. No. 527,371, filed Aug. 26, 1983, now U.S. Pat. No. 4,473,112, issued Sept. 25, 1984 which is in turn a continuation of application Ser. No. 236,646, filed Feb. 23, 1981, now abandoned.

BACKGROUND OF THE INVENTION

The present invention is directed to multiple pass manifolds for tube bundles.

Large scale moisture separator-reheaters and other heat transfer equipment for steam power generation have found great utility in recent years. Such equipment typically employs horizontally arranged tube bundles having a large number of tubes which extend substantially the length of the device and return. Such equipment incorporates a header or manifold to direct steam or other heat transfer fluid to one end of the tubes of a tube bundle and collect the exiting vapor or condensate from the other end of the tubes.

Conventional manifolds have generally been designed to provide two pass and four pass systems. In a two pass system, the header requires a single baffle located to divide the header into two portions to separate the ends of each of the tubes. In this way, two passes substantially through the length of the heat transfer shell are possible.

In the standard four pass arrangement, an additional baffle is required to segregate a portion of the tubes normally associated with the first pass portion of the manifold in a two pass system. Thus, the first pass is made through, for example, the top half of the tube ends extending through the tube sheet. The bottom half of the tube bundle is retained as it was in the two pass system such that the fluid can exit from the tubes associated with the first pass system and re-enter the tubes blocked off from the first pass system in a counter flow. This arrangement results in the fluid flowing through a third and fourth pass to finally exit out of the ends of the tubes in the upper half of the tube bundle blocked off from the first pass.

A number of disadvantages exist with both the two pass and the conventional four pass systems. In the two pass system, it is relatively difficult to control the cooling rate in the tubes such that the condensate will not fill or block the heat transfer tubes. In the case of the conventional four pass system, the same difficulty of tube blockage arises partly because the third and fourth pass require the flow to move up rather than down in the tube bundle. In spite of the fact that the liquid condensate is eventually blown from the tube through continuous operation of the equipment, the formation, blockage and release of the condensate creates excessive thermal stress on the tubes and the associated equipment. Consequently, excessive deterioration has been experienced. In spite of the disadvantage of the four pass system, the four pass system allows for lower heat removal per pass and also for intermediate condensate removal. Both of these features allow better control of the tube condition with reduced slugging of subcooled condensate in saturated steam within the discharge legs of the tubes.

In part, the foregoing problems have resulted from the excessive size of current-day moisture separator-reheaters which have been developed for nuclear power plants. The systems include moisture separators combined with heat transfer units to dry and heat the low pressure steam prior to its entry into the low pressure turbine. With the dual functions of these devices and their excessive size, slugging and blowing of tubes is difficult to control.

To look in more detail to this thermal hydraulic instability resulting in severe oscillations in the tubes, it is believed to be a cause and effect syndrome. The cause may lie in the reheat bundle itself, where large steam volume diminishes into low liquid volume. This volumetric change, particularly at the lower portion of the bundle, is associated with changing hydraulic patterns as the two phase flow progressively transforms from annular flow at the tube inlet to slug flow at the flooded discharge. In addition, this oscillation-prone flow in the tubes is subject to erratic change of the phase transition point between the diminishing vapor core and the start of the flooding zone. The situation is aggravated by intermittent, inherent pressure perturbations associated with either bubble collapse or local flashing. On the other hand, oscillations may be triggered by external hydraulic perturbations not originating in the reheat bundle itself. Such external perturbations might include flashing in particularly full drain lines, operation of a control valve whose opening is not properly positioned to the set point deviation, or non-uniform discharge streams flowing into the exit due to higher condensation rates at the lower tubes. In any event, once such oscillation begins, the resulting syndrome is very difficult to control since the induced secondary oscillations may be of even larger amplitudes, and in the case of pressure fluctuations, once created, are often self-sustaining.

Further complications can arise from the fact that the zones flooded with increasing subcooled condensate are not of constant length. The zones are not of constant length because of lack of control over the discharge header pressure changes resulting from intermittent drainage of subcooled condensate and of saturated steam. Since the flooded links are inefficient heat transfer areas, they affect the shell side flow, causing local degradation in superheat levels. In turn, the temperature degraded zones increase the condensation rates within the tubes and thus cause secondary interference on the oscillating system.

Thus, the tube side two phase flow oscillations are inherently coupled with severe cyclic condensate subcooling which has been found to be proportionately greater in the lower portions of the tube bundles. The alternative discharge of saturated steam and slugs of subcooled water creates alternating temperature peaks along the discharge legs and around the tube-to-tube sheet joints which develop and decay in tandem with the discharge of saturated steam. The severity of such temperature peaks can result in thermal stresses which will cause detrimental fatigue failures to the tubes and to joints within the system.

The heating capability of the tube side flow has also heretofore lacked the versatility necessary to obtain a uniform heating of the shell side flow. As a result, losses in overall efficiency as well as excessive regional tube side subcooling can exist. Of particular concern are the regions of the shell side flow adjacent the sides of the shell. A greater amount of tube side heat is demanded in these areas.

Exemplified by development of the conventional four pass system mentioned above, the main course of refinement in moisture separator-reheater technology in recent years has been specifically directed to the stabilization of the two phase flow as a means to reduce the probability of tube failures and extend reheater service life. The following have operated as partial solutions or improvements in this area.

1. Flow restrictions in the reheater inlet header to equalize the flow through the tubes.
2. Multi-tube-bank bundle, where the condensate is discharged at each bank exit while steam flows in series from bank to bank.
3. High excess steam rate through all tubes.
4. Employment of varying tube diameters on a horizontal configuration and withdrawal of non-condensing steam with some excess steam to normalize the hydraulic characteristics of all tubes and establish a discharge header pressure.
5. Retrofitting existing two pass reheater bundles with internal headers which alter the condensing steam path from the two passes into four passes while draining the accumulated liquid phase at the discharge of the second pass and routing the combined two phase flow exiting from the fourth pass into a single discharge line.
6. Providing internal secondary internal steam condensing coils which condense excess steam flow through the primary bundle.

Thus, a variety of designs have been attempted to resolve the aforementioned problems. One complete MSR design is illustrated in Yardin et al., U.S. Pat. No. 4,016,835, the disclosure of which is incorporated herein by reference.

In arriving at more complicated manifold requirements, greater sophistication is required in the header or manifold. Such added sophistication yields its own problems in sealing, thermal loading, flow distribution and the like. A natural division exists in the conventional tube bundles between the legs of the U formed by the tubes. However, if more than two passes are desired, more complicated sealing between closely spaced tubes is required. Thermal stress loading and flow distribution are also complicated by additional baffling.

SUMMARY OF THE INVENTION

The present invention is directed to an improved header or manifold configuration for moisture separator-reheaters and other heat transfer tube bundles. A four pass system is employed which better controls the distribution of heat and the two phase flow in such tube bundles. The four passes are accomplished by dividing the bundle into four sections with a first pass directed through an inverted U-shaped configuration of tube bundles, collecting the discharge from the corresponding discharge legs, and redirecting the flow to the remaining upper portion of the legs of the tube bundle for subsequent discharge from the corresponding upper portion of the lower half of the bundle. Vertical U-bends are employed in this arrangement to obtain the appropriate flow in conjunction with the manifold of the present invention.

The manifold of the present invention concludes a central divider and distribution boxes to provide a four pass system. The boxes separate portions of the tubes from the main header cavities. These boxes provide a versatile gasket sealing mechanism and can be made removable for service and system amendment. The design is intended to give maximum thermal stress flexibility while still maintaining the required seal between the several components. A diffuser accommodates the inverted U-shaped configuration of the first pass tubes by directing flow in a somewhat U-shaped pattern toward the tube sheet. Condensate discharge from the tube bundle is accomplished following both the second and fourth passes. This discharge can be accomplished from dual outlets which are individually controlled as to manifold pressure.

The U-shaped configuration of the first and second passes provides greater tube side heat to meet the greater demand of the shell side flow in these regions.

Accordingly, it is an object of the present invention to provide an improved tube bundle manifold for large heat transfer systems. Other and further objects and advantages will appear hereinafter.

DETAILED DESCRIPTION OF THE PREFERRED EMBODIMENT

Figure 1:
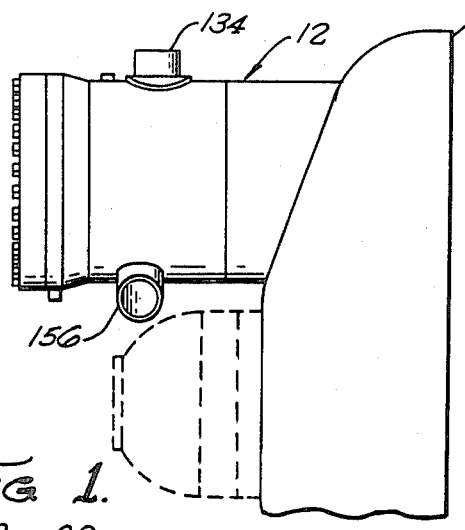
FIG. 1 is a partial side elevation of a moisture separator-reheater with a manifold of the present invention.
Figure 2:
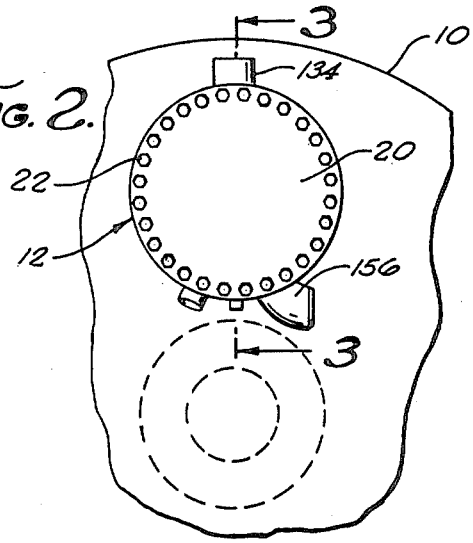
FIG. 2 is an in view of the device of FIG. 1.
Figure 4:
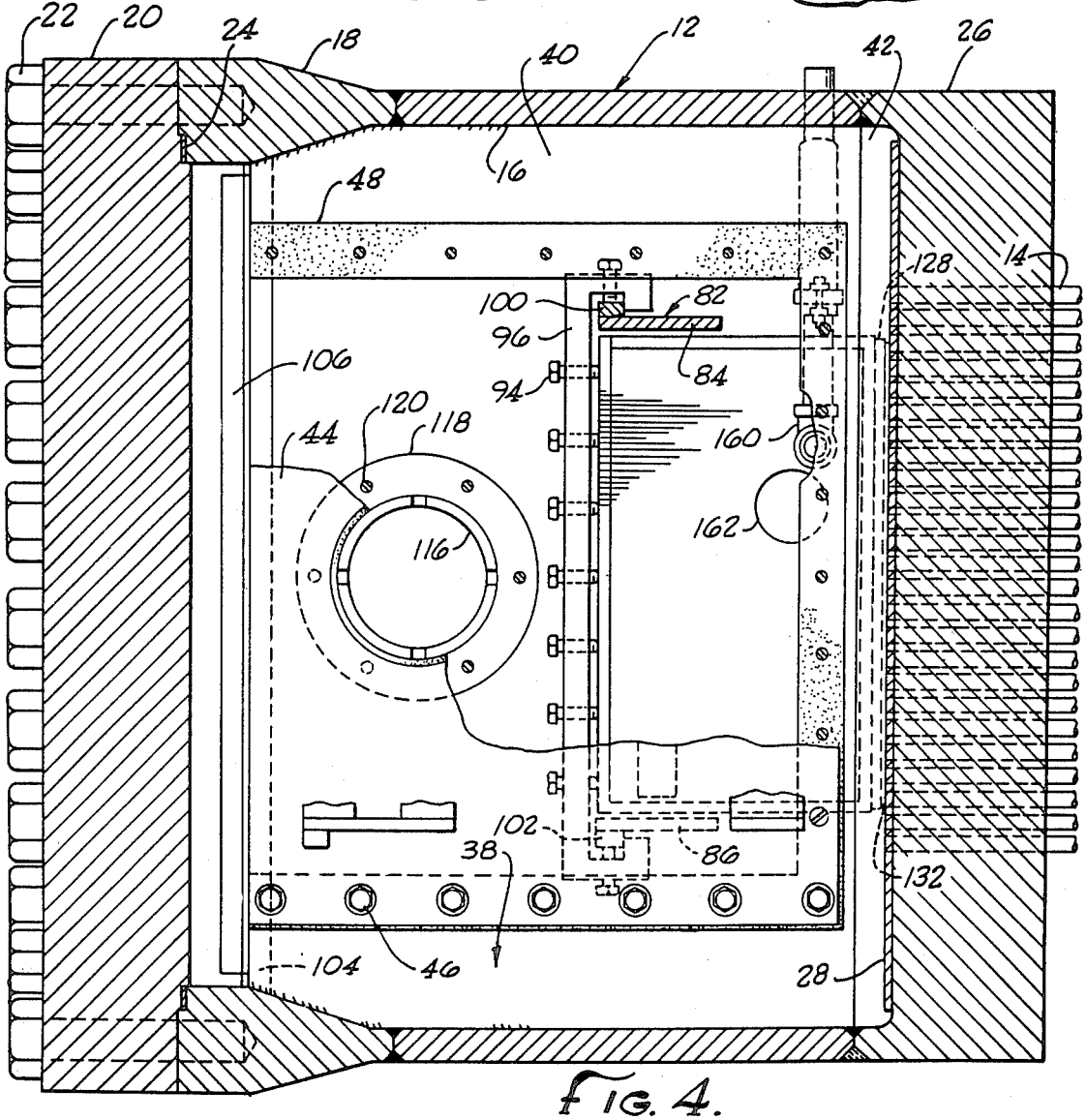
FIG. 4 is a cross-sectional plan view taken along line 4—4 of FIG. 3.
Figure 3:
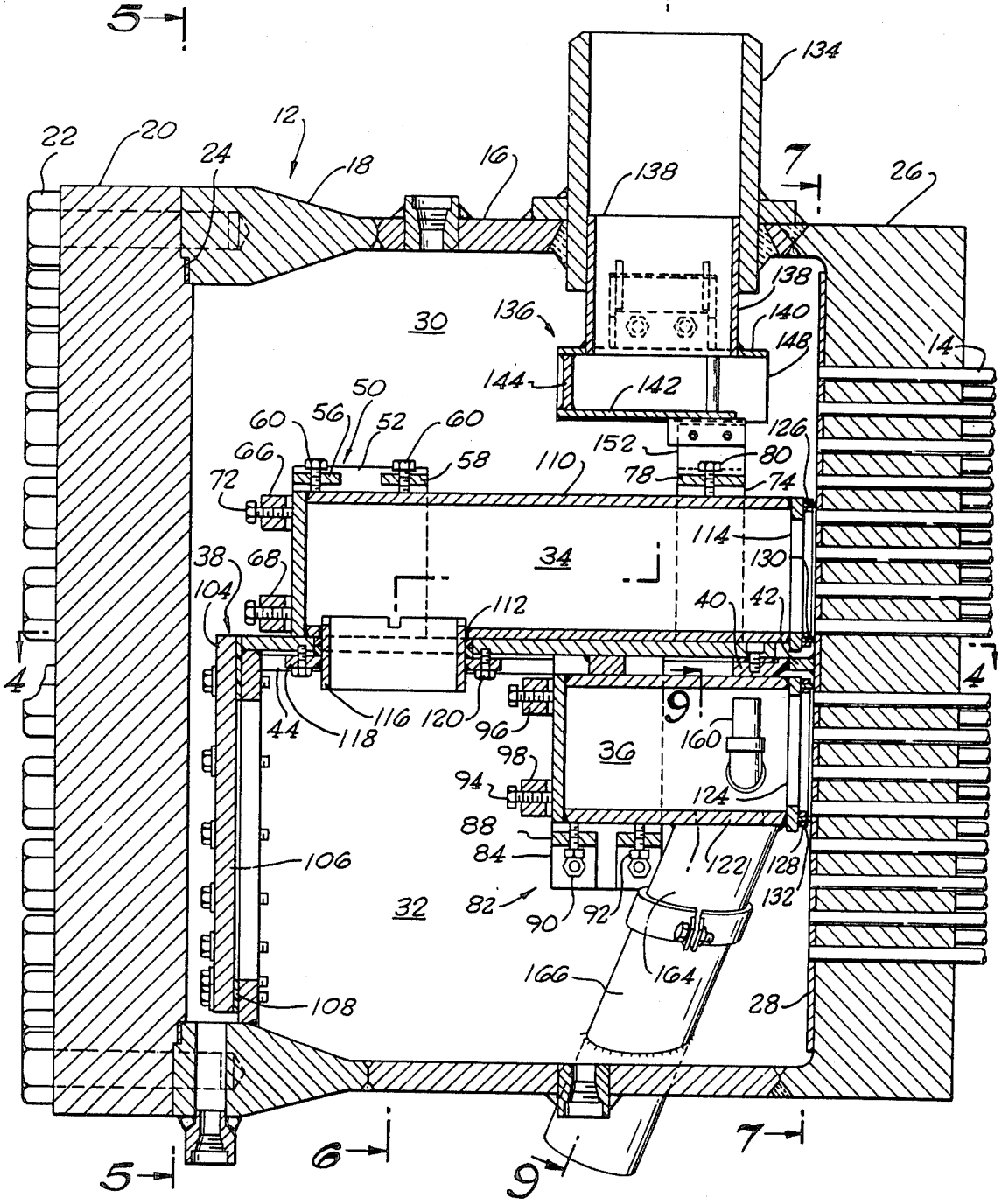
FIG. 3 is a cross-sectional elevation of the manifold of the present invention taken along line 3—3 of FIG. 2.
Figure 7:
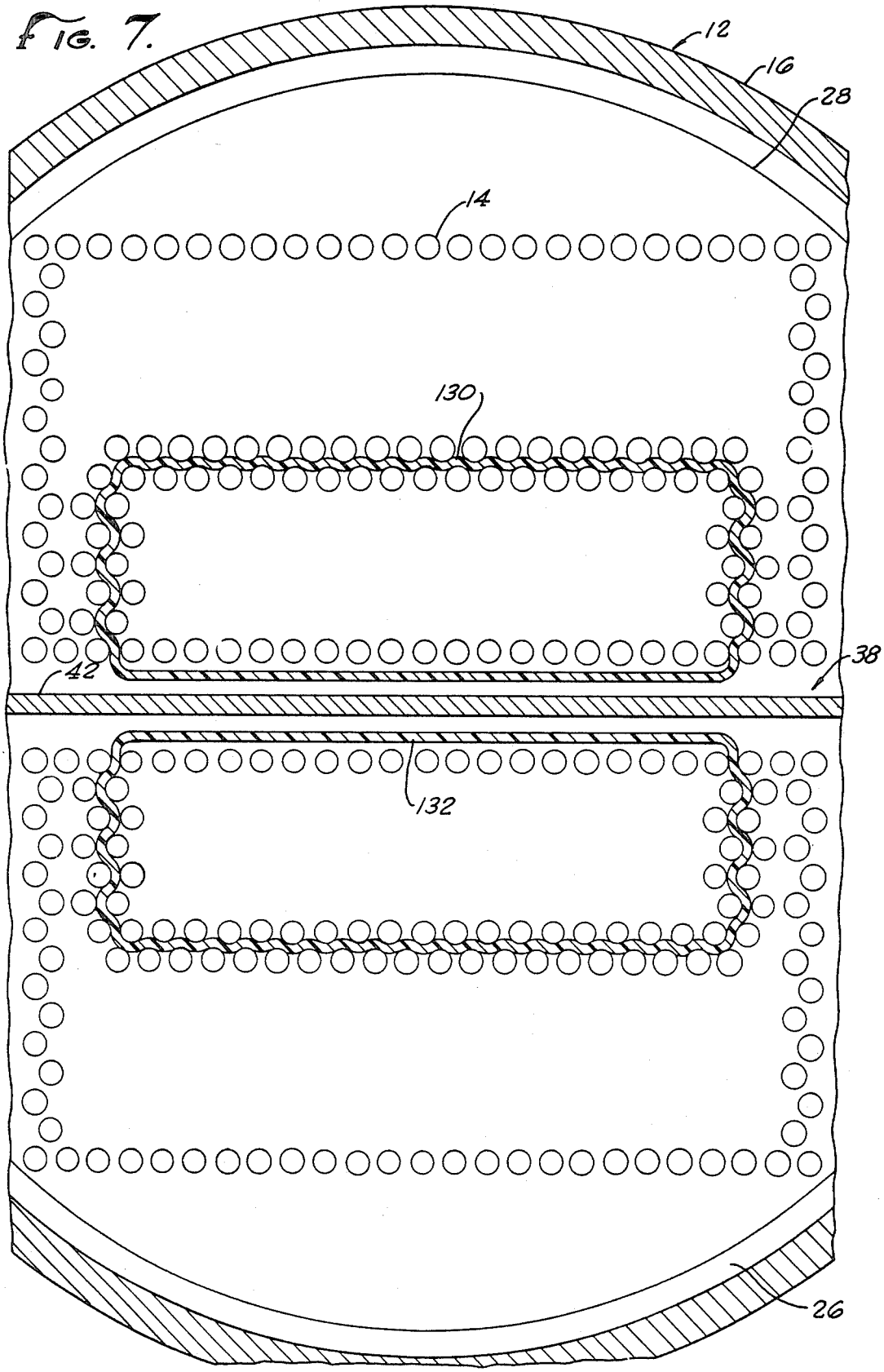
FIG. 7 is a cross-sectional in view taken along line 7—7 of FIG. 3.
Figure 8:
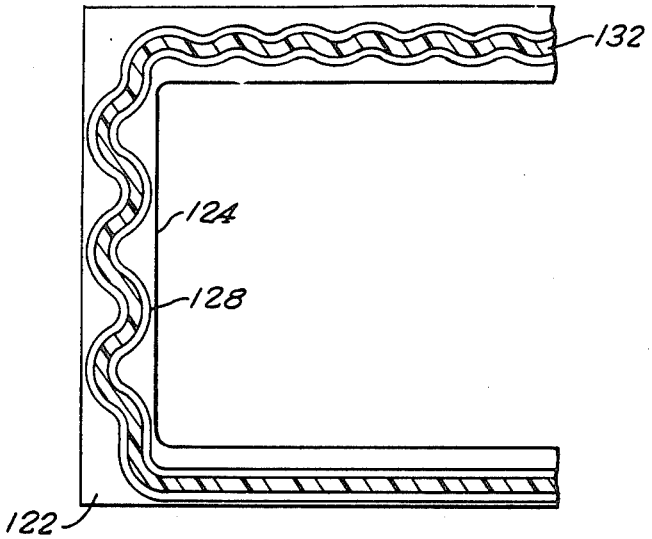
FIG. 8 is a detailed cross-sectional view of the gasket taken along line 7—7 of FIG. 3 and looking in the oposite direction.

Turning in detail to the drawings, a portion of a moisture separator-reheater 10 is illustrated in FIG. 1. Attached to the moisture separator-reheater 10 is a manifold 12 of the present invention. The moisture separator-reheater 10 with the exception of the manifold 12 is of conventional construction employing shell side flow upwardly through the shell of the device and tube side flow through tube bundles extending substantially horizontally through the device. In this case, the tube bundles include tubes 4, the ends of which are illustrated in FIGS. 3, 4 and 7, for example, arranged with vertical U-bends such that the uppermost tube returns as the lowermost tube to the manifold 12. Similarly, the lowermost tube in the upper half of the bundle returns as the uppermost tube in the lower half of the tube bundle. The division between the upper half and the lower half of the tube bundle is seen as the larger space between tubes 14 in FIG. 3. The feed and discharge legs of the tubes 14 are defined by flow into or out of the tubes respectively from or to the manifold.

The manifold, generally designated 12, includes a cylindrical manifold housing 16 having a channel flange 18 welded thereto. Associated with the manifold housing 16 and particularly to the channel flange 18 is an end cap 20. The end cap 20 is held to the manifold housing 16 by means of fasteners 22. A ring gasket 24 is compressed between the channel flange 18 and the cap 20 to aid in formation of a seal.

The manifold housing 16 is welded at its other end to a tube sheet 26. The tube sheet 26 provides a locating and joint mechanism for the tubes 14 of the tube bundle. As part of the tube sheet 26, a cover sheet 28 is positioned on the housing side thereof to which the tubes are welded. For the present purposes, the composite tube sheet and cover sheet are here referred to as the tube sheet 26.

Looking to the interior of the manifold housing 16, a composite baffle means is provided to effect a four pass system. To this end, four distinct cavities are defined within the manifold housing 16. These cavities are defined by a combination of the manifold housing 16, the tube sheet 26, and the several baffles located within the housing 16. The four cavities, as best seen in FIG. 3, include a first feed cavity 30, a first discharge cavity 32, a second feed cavity 34, and a second discharge cavity 36. The first feed cavity 30 manifolds incoming flow to the first pass feed legs which is returned to the first discharge cavity 32 by the associated discharge legs of the same tubes. The second feed cavity 34 manifolds flow to the third pass to the upper end of a second group of tubes which is returned to the second discharge cavity 36 in a fourth pass. Naturally, the first discharge cavity 32 and the second feed cavity 34 may be considered and actually configured as a single cavity. However, in the interest of clarity, the foregoing will be discussed as separate cavities with the understanding that structurally a single open volume or cavity is understood to be included.

The interior of the manifold housing 16 includes a main baffle 38. The main baffle 38 forms the primary structural support for the remaining components within the manifold housing 16 and includes a mounting flange 40 positioned diametrically in the manifold housing 16. The mounting flange 40 is U-shaped to meet with the manifold housing 16 and the tube sheet 26 and provide an open interior portion. A bar 42 forms part of the mounting flange 40 to act as a transition between the main body of the mounting flange 40 and the cover sheet 28 of the tube sheet 26.

Figure 5:
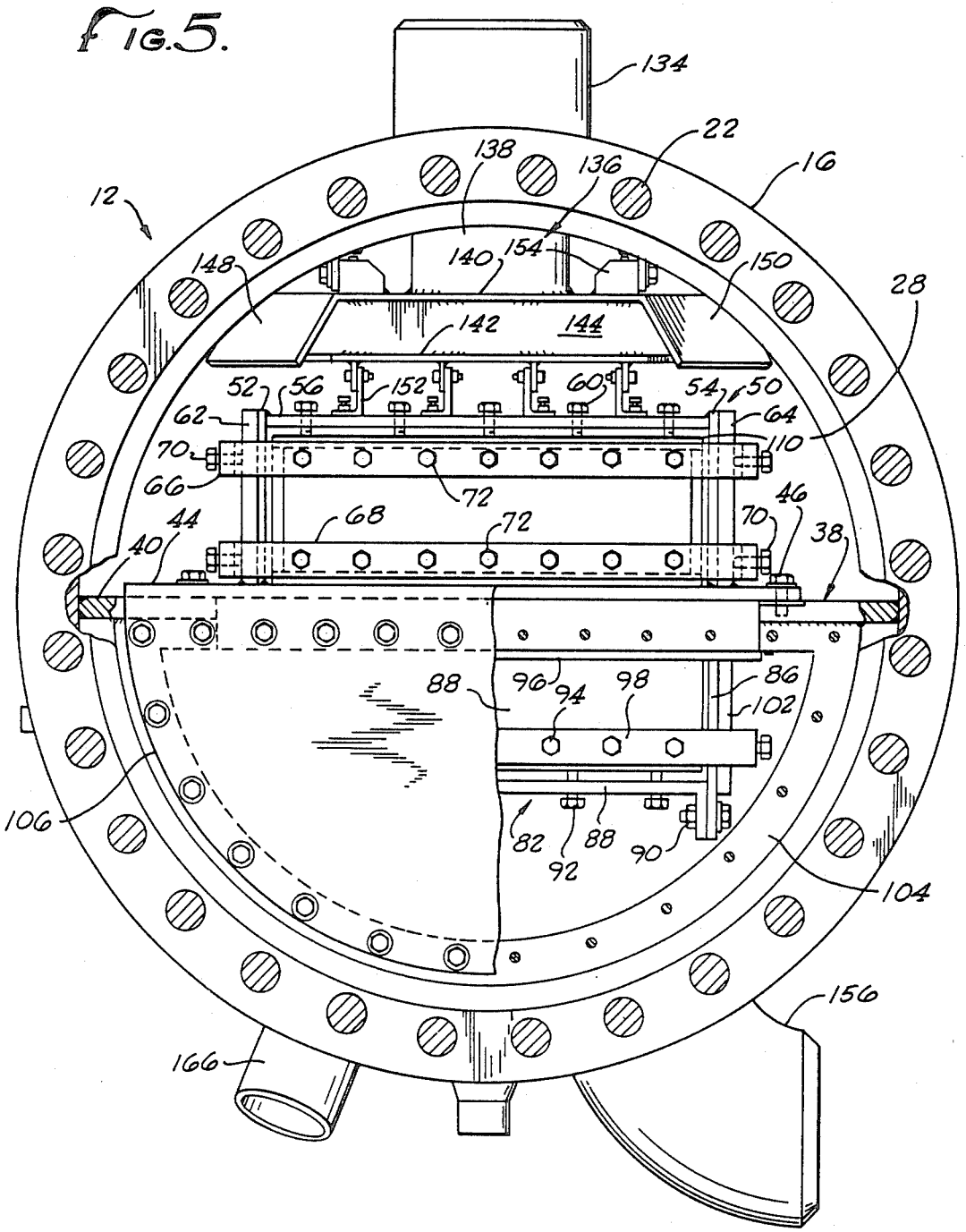
FIG. 5 is a cross-sectional inview taken along line 5—5 of FIG. 3.
Figure 6:
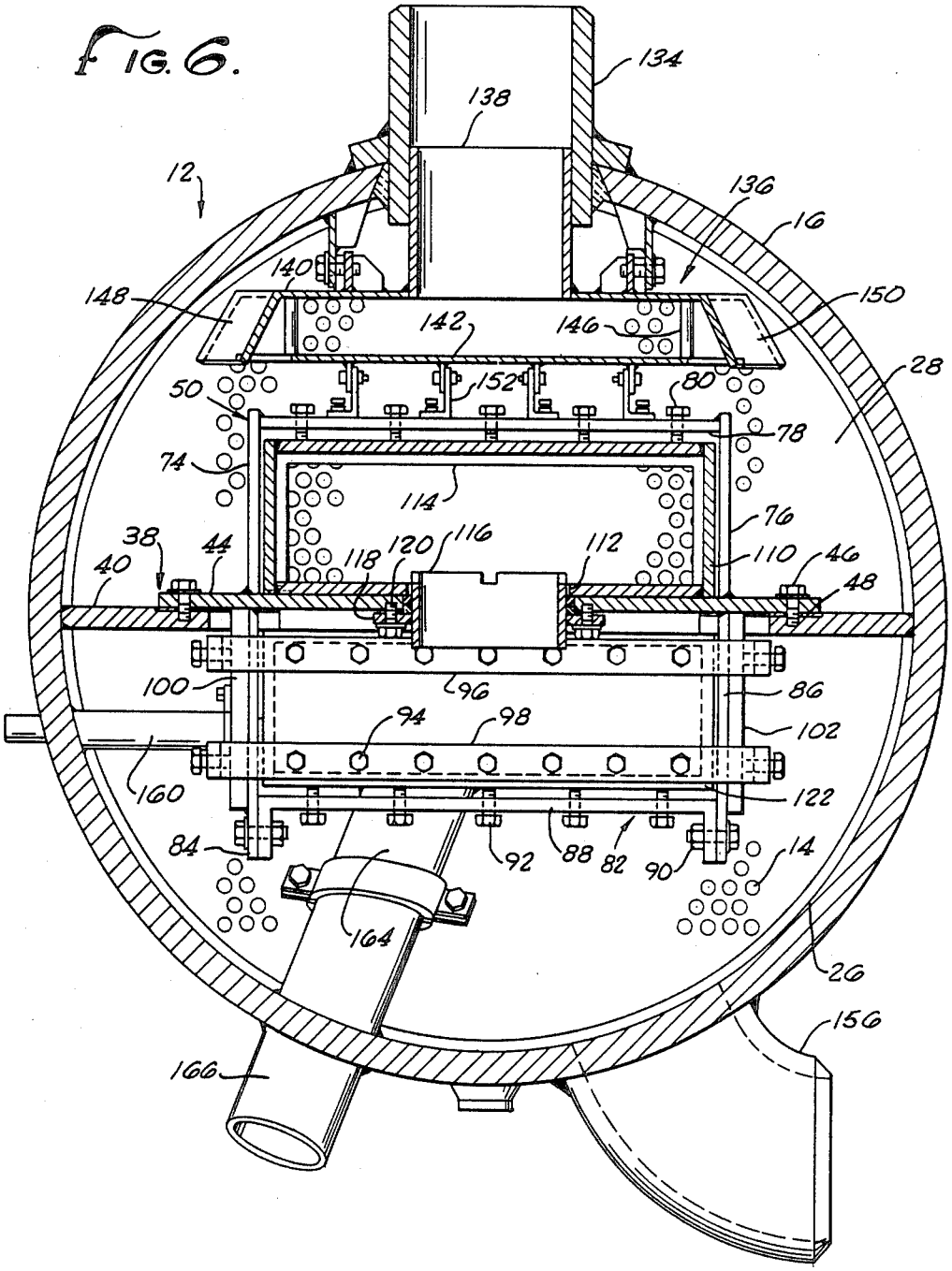
FIG. 6 is a cross-sectional in view taken along line 6—6 of FIG. 3.

Positioned on the mounting flange 40 to further define the main baffle 38 is a mounting plate 44. The mounting plate 44 is fastened to the mounting flange 40 by means of fasteners 46. A gasket 48 provides a sealed joint between the mounting flange 40 and the mounting plate 44. The main baffle 38 defined by the mounting flange 40 and the mounting plate 44 provides a main structural base for additional baffling means within the manifold housing 16. A first frame, generally designated 50, is fixed to the mounting plate 44. The first frame 50 is comprised of two rectangular elements. The elements are aligned such that a box, further described below, may be slid into the frame members on the mounting plate 44 and secured against the tube sheet 26. The rectangular element most distant from the tube sheet 26 includes vertical members 52 and 54 connected by horizontal members 56 and 58. This arrangement may best be seen in FIGS. 3 and 5. The horizontal members 56 and 58 include adjustable compression members in the form of fasteners 60 which are in threaded engagement with the horizontal members 56 and 58 such that they may be adjustably screwed into compressive engagement with the distribution box discussed below. Located on the vertical members 52 and 54 are vertical bars 62 and 64 which provide purchase for jack bars 66 and 68. The jack bars 66 and 68 are designed to hold the box positioned within the frame in a compression condition against the tube sheet 26. To this end, fasteners 70 locate the jack bars 66 and 68 and fasteners 72 provide the compression to hold the box against the tube sheet 26. As the jack bars are not welded to the first frame, reaction to the compression load provided by fasteners 72 is taken by the vertical bars 62 and 64.

The second rectangular element, which is closer to the tube sheet 26, is also defined by two vertical members 74 and 76 with a horizontal member 78. The horizontal member 78 is employed with fasteners 80 as are the horizontal members 56 and 58.

A second frame, generally designated 82, is fixed to the underside of the mounting plate 44 to position a second box, more fully described below. The second frame 82 includes vertical members 84 and 86 tied together by a horizontal member 88. In this case, as can be seen from FIG. 5, the horizontal member 88 is bolted rather than welded to the vertical members 84 and 86 by fastener 90. As with the first frame, the second frame includes adjustable compression members for forcing the box positioned therein against the main baffle 38 and against the tube sheet 26. To this end, fasteners 92 compress the enclosed box upwardly and fasteners 94 which cooperate with jack bars 96 and 98 and vertical bars 100 and 102 compress the enclosed box against the tube sheet 26.

The main baffle 38 does not extend to the cap 20. Consequently, the baffle must be continued downwardly in a semicircular arrangement to close off the bottom portion of the manifold housing 16 from the upper portion. To this end, a bulkhead 104 having a removable access panel 106 is positioned vertically in front of the cap 20. A gasket 108 seals the joint between the removal access panel 106 and the frame of the bulkhead 104.

Positioned within the upper or first frame 50, is a first distribution box 110. The first distribution box 110 is rectangular and fits within the frame 50. It is substantially closed with the exception of a port 112 located in the bottom panel thereof and an opening 114 at the end of the box positioned nearest the tube sheet 26. By holding the first distribution box 110 against the tube sheet 26, the second feed cavity 34 is defined to include approximately 40% of the upper leg of the U-shaped tube bundle. Unimpeded access to a portion of the tubes is made available by the opening 114. The port 112 accommodates a short pipe 116 held to the underside of the mounting plate 44 by means of a flange 118 and fasteners 120. The pipe 116 forms a passage between the first discharge cavity 32 and the second feed cavity 34.

Associated with the second frame 82 below the mounting plate 44 is a second distribution box 122. This second distribution box 122 defines the second discharge cavity 36, and, like the first distribution box 110 is substantially closed with the exception of an opening 124 adjacent the tube sheet 26. Outlets are also provided from the second distribution box 122 as will be more fully discussed below.

Adjacent to both of the openings 114 and 124 of the first and second distribution boxes respectively, channels 126 and 128 are arranged such that they are facing in the same direction as the opened end of the boxes, toward the tube sheet 26. Resilient gaskets 130 and 132 are positioned in the channels 126 and 128 to seal the perimeters of the openings 114 and 124 with the tube sheet 26. As is evident from FIG. 7, the channels and gaskets are constructed and arranged to extend between the tubes 14 which requires a circuitous path with the exception of the portion near the main baffle 38.

FIG. 7 also provides a full understanding of the pattern in which the tubes are segregated in the preferred embodiment. Because of the vertical U-bends, there is a corresponding lower tube end for every upper tube end on the other side of the main baffle 38. The gaskets 130 and 132 operate to separate out a group of tube ends associated with common tubes for the third and fourth passes of the flow. Because the first and second distribution boxes 110 and 122 do not extend to the edge of the tube bundle, the group of tubes associated with the first feed cavity 30 are disposed in an inverted U-shaped configuration while the group of tubes associated with the first discharge cavity 32 form an upright U-shaped configuration.

To direct flow into the manifold 12, a main inlet 134 is provided. This main inlet 134 extends through the manifold housing 16 to meet with a manifold diffuser, generally designated 136. The manifold diffuser 136 includes an inlet tube 138 which in turn is fixed to a shroud plate 140. The shroud plate is provided with an opening for communication with the inlet tube 138. Positioned perpendicular to the inlet tube and parallel to the shroud plate is an impingement plate 142. The impingement plate 142 is held relative to the shroud plate 140 by means of a closure panel 144 located on the edge of both the shroud plate 140 and impingement plate 142 at a position most distant from the tube sheet 26. Furthermore, spacers 146 also help to hold the impingement plate 142. The shroud plate 140 includes deflection panels 148 and 150 which extend downwardly toward the impingement plate 142 and also outwardly to define passages between the deflection panels 148 and 150 and the impingement plate 142. The shroud plate 140 and the impingement plate 142 are configured in association with the deflection panels 148 and 150 such that the deflection panels are splayed outwardly toward the tube sheet 26.

The overall effect of this manifold diffuser arrangement is to direct incoming flow to the inverted U-shaped configuration in the most efficient manner possible. In this regard, the closure panel 144 prevents any main portion of the flow from moving away from the tube ends, the diffuser panels 148 and 150 direct flow down toward the legs of the inverted U-shaped configuration, and the main opening between the shroud plate 140 and the impingement plate 142 directs flow to the main body of the tube ends.

To support the manifold diffuser 136, brackets 152 fix the diffuser relative to the horizontal member 56 of the first frame 50. From above, brackets 154 fix the diffuser relative to the manifold housing 16.

For separation of the condensate from the first two passes through the tube bundle, a condensate outlet 156 extends through the manifold housing 16. This outlet is located at approximately the bottom of the manifold housing within the first discharge cavity 32 to insure maximum removal of condensate.

The remaining vapor is directed upwardly through the passage through pipe 116 to the second feed cavity 34. Thus, an intermediate discharge of condensate is achieved.

Figure 9:
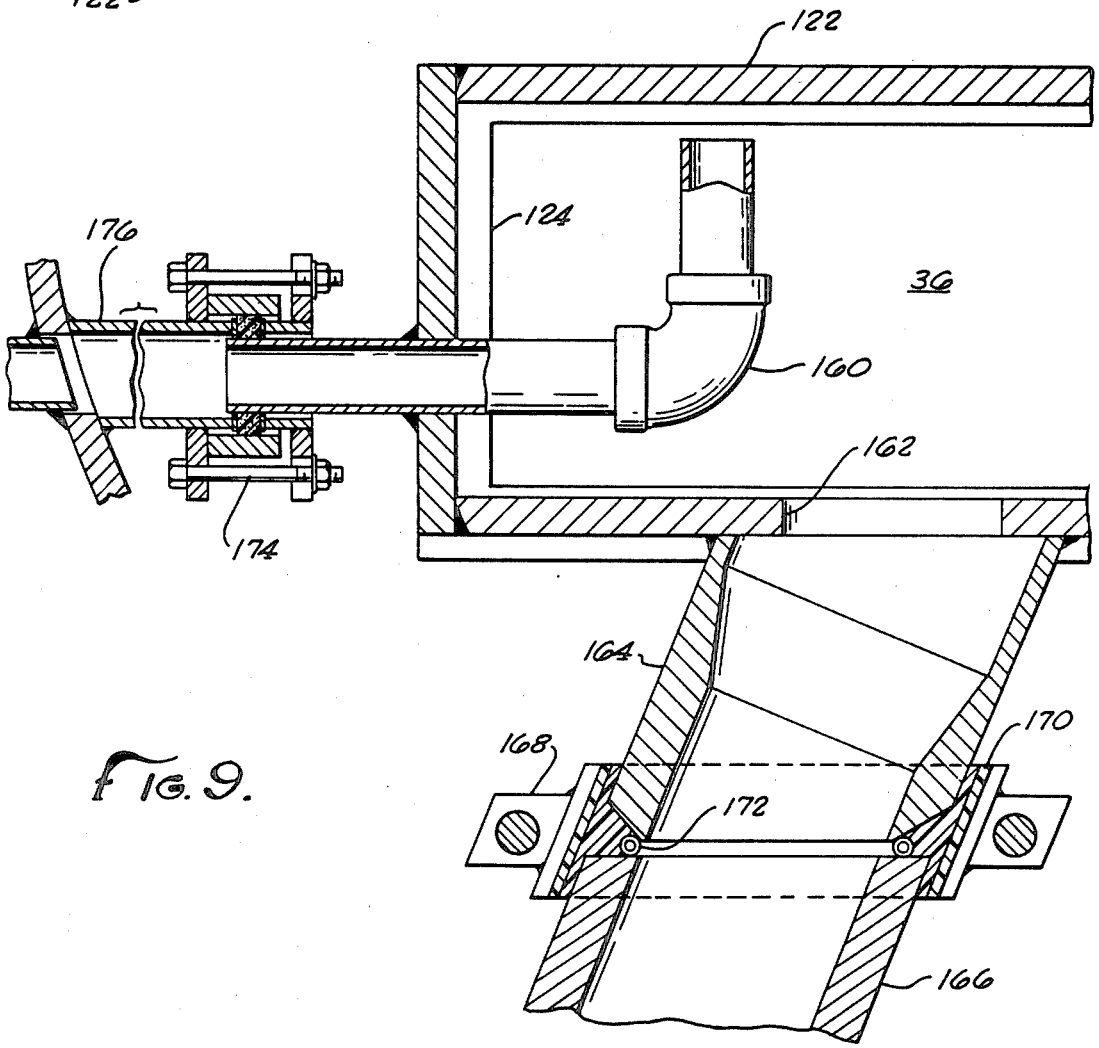
FIG. 9 is a detailed cross-sectional view taken along line 9—9 of FIG. 3.

The second discharge cavity 36 also has a condensate outlet 158. Further, a vapor outlet 160 directs whatever remaining uncondensed vapor remains from the system. The arrangement for the condensate outlet 158 and the vapor outlet 160 is best illustrated in FIG. 9. The condensate outlet 158 includes a passage 162 through the bottom of the second distribution box 122 and a short drain pipe 164. To allow removal of the second distribution box 122 from the manifold housing 16, the drain pipe 164 does not extend to the manifold housing 16. Rather, a second drain pipe 166 extends from adjacent the first drain pipe 164 through the manifold housing 16. To seal the first and second drain pipes 164 and 166, a two-part clamp 168 is employed which is bolted together about the joint. Interior to the clamp 168, a packing element 170 is positioned to further seal the discharge pipe. This packing element includes a reinforced portion 172 which may include a spring embedded within the material.

The vapor outlet 160 is a pipe having a downward outlet located in the upper portion of the second discharge cavity 36. Thus, the remaining vapor can be drawn off separate from the condensate. As the vapor outlet 160 is associated with the second distribution box 122, it must be removable from the pipe extending from the manifold housing 16. Consequently, a joint 174 is provided which is coupled to both the vapor outlet 160 and a conduit 176 associated with the wall of the manifold housing 16.

It is contemplated as part of the preferred embodiment that the various drains be controlled to maintain a relatively constant pressure. Consequently, a pressure device may be employed with each of the several drains. To this end, the convenience of a discharge located a fixed distance below the liquid level of a condensate container provides a relatively fixed head. By employing two such systems, one for each of outlets 156 and 166, independent fixed pressure levels can be maintained.

Thus, an improved manifold system for large heat transfer tube bundles is here disclosed. While embodiments and applications of this invention have been shown and described, it would be apparent to those skilled in the art that many more modifications are possible without departing from the inventive concepts herein described. The intention, therefore, is not to be restricted except by the spirit of the appended claims.

What is claimed is:

1. A manifold for a tube bundle having a tube sheet at a first end of said bundle, comprising a manifold housing fixed to the tube sheet, a baffle dividing the interior of said manifold housing, a first frame fixed to one side of said baffle, a second frame fixed to the other side of said baffle, a first distribution box positioned in said first frame against the tube sheet, a second distribution box positioned in said second frame against the tube sheet, said baffle, said first box, said second box, and said manifold housing defining four cavities in communication with the tube sheet, and adjustable conpression members extending between said first and second frames and said first and second distribution boxes.

2. The manifold of claim 1 further comprising gaskets positioned between said distribution boxes and the tube sheet.

3. The manifold of claim 1 wherein said first and second frames and said first and second distribution boxes are positioned inwardly and spaced from the wall of said manifold housing.

4. The manifold of claim 1 wherein said compression members include fasteners in threaded engagement with said frames and constructed and arranged to be adjustably screwed against the walls of said boxes to hold said boxes against said baffle and the tube sheet.

5. The manifold of claim 1 wherein said baffle includes a mounting flange fixed to the inner side of said manifold housing and a mounting plate extending within said manifold housing to said mounting flange to divide the interior of said manifold housing, said first and second frames being fixed to said mounting plate.

* * * * *